United States Patent [19]

Zeuthen

[11] 4,088,868

[45] May 9, 1978

[54] FUSER COOLING SYSTEM

[75] Inventor: Karl Gustav Zeuthen, Gentofte, Denmark

[73] Assignee: Rex-Rotary International A.S., Copenhagen, Denmark

[21] Appl. No.: 742,070

[22] Filed: Nov. 15, 1976

[30] Foreign Application Priority Data

Nov. 17, 1975 United Kingdom ..... 47288/75

[51] Int. Cl.[2] ..... H05B 1/00

[52] U.S. Cl. ..... 219/216; 219/388; 432/59

[58] Field of Search ..... 219/216, 388; 355/3 FU; 432/59–60, 227–228

[56] References Cited

U.S. PATENT DOCUMENTS

| | | | |
|---|---|---|---|
| 3,280,717 | 10/1966 | Bungay | 219/216 X |
| 3,757,081 | 9/1973 | Smith et al. | 219/388 X |
| 3,836,322 | 9/1974 | Harwig et al. | 219/388 X |
| 3,907,492 | 9/1975 | Drangelis et al. | 219/388 X |

FOREIGN PATENT DOCUMENTS

| | | | |
|---|---|---|---|
| 1,083,692 | 9/1967 | United Kingdom | 219/216 |

OTHER PUBLICATIONS

G. T. Williams, Image Fuser, IBM Technical Disclosure Bulletin, vol. 13, No. 10, Mar. 1971.

*Primary Examiner*—C. L. Albritton
*Attorney, Agent, or Firm*—Fleit & Jacobson

[57] ABSTRACT

A radiant heat fuser for an electrostatic copying machine in which heat for fusing the delicate toner image on top of a sheet is applied using a top heater of radiant type, and background heat to the underside of the sheet is provided by means of heat-absorbing and -radiating elements positioned in the fuser bed and arranged to absorb radiant heat while no sheet is being fed and to radiate and convect heat to the underside of the sheet as it passes through the fuser. The control of the temperature of these heat-absorbing and -radiating elements is achieved by way of a cooling air system throttled in accordance with temperature-responsive deformation of the heat-absorbing and -radiating elements some of which are accordingly of bimetallic form.

10 Claims, 7 Drawing Figures

1
2
3
4
6
8
9
10
11
14
15
16
17
18
19
20
21
22
23
24
25
26
28
29
30
35a
180
A
B
D

FUSER COOLING SYSTEM

The present invention provides an improvement in electrostatic copiers, and in particular provides a new fuser system with automatic temperature control.

It is known, for example from German Offenlegungsschrift No. 1,957,515, to provide a fuser for an electrostatic copying apparatus in which heat is radiated down from above onto the copy sheet bearing an unfused toner image, while at the same time a supplementary heat source within the fuser bed supplies background heat to the rear of the paper to ensure that the paper is warmed up independently of the absorption of heat by the toner, thereby ensuring that not only does the toner image itself become fused at the upper surface, but also that this fused image becomes well bonded to the paper substrate. Such a supplementary heater device also calls for thermostatic control means to prevent overheating of the background heater. Besides, in order to avoid burning of the sheet of paper, the output of the supplementary heater in the fuser bed is kept low and hence the rate of warm up of that supplementary heater is very low.

It is an object of the present invention to provide for the application of heat to the underside of a sheet of paper passing over the fuser bed in a radiant heat fuser while avoiding the need for a separately energised heat source in the fuser bed and while ensuring rapid warm up of the fuser bed.

According to the present invention we provide a fuser for an electrostatic copier, comprising a fuser bed, over which, in use a sheet bearing an unfused image will be fed; a radiant heat source and a reflector above said fuser bed and arranged to direct radiation from said heat source towards said fuser bed for fusing a delicate toner image on a sheet of copy paper passed over said fuser bed in use of the fuser; heat-absorbing and-radiating elements disposed in said fuser bed below the flow path of a copy sheet through the fuser; means for admitting air to said fuser bed below the said heat-radiating and -absorbing elements; an outlet passage from said fuser bed communicating a cooling air port just below said heat-absorbing and -radiating elements with an outlet from the fuser bed; means for connecting a suction source to said outlet from the fuser bed to induce airflow through said fuser bed directly below and in contact with said heat-absorbing and -radiating elements by way of said means for admitting air, said cooling air port and said outlet; and thermostatic control means for throttling said cooling airflow through said port in response to the temperature of said heat-absorbing and -radiating elements.

Preferably the thermal power of the radiant energy source in the fuser cover may be so high as to require continuous cooling to balance the normal output of the source, so that upon start up with the air flow throttled back the rate of warm-up will be extremely rapid.

Conveniently the cooling air flow in the fuser bed is derived from a suction system which is required for some other function of the electrostatographic copier and the flow rate through the fuser is throttled to an extent related to the temperature in the fuser bed. More conveniently the suction system which drives the cooling air flow is the suction manifold to a sheet feed suction source.

In order that the present invention may more readily be understood the following description is given, merely by way of example, reference being made to the accompanying drawings in which.

Figure 1:
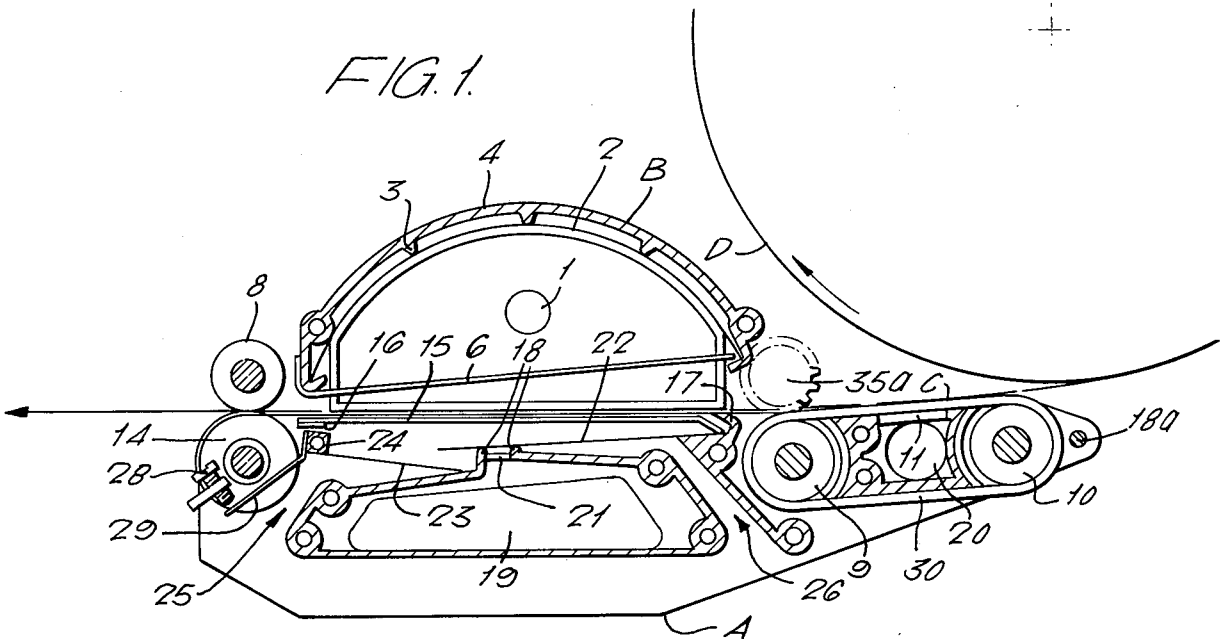
FIG. 1 is a sectional view taken along a vertical plane parallel to the direction of sheet movement through the fuser.
Figure 3A:
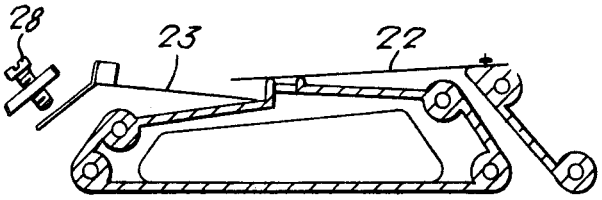
Figure 3B:
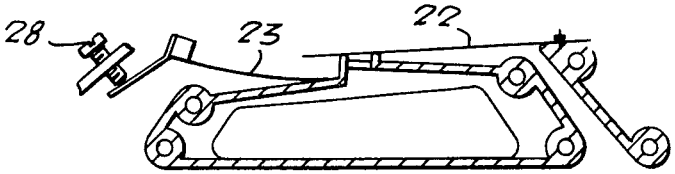
Figure 3C:
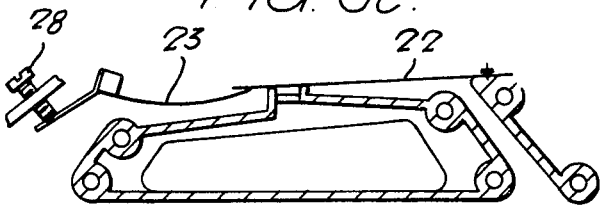
Figure 3D:
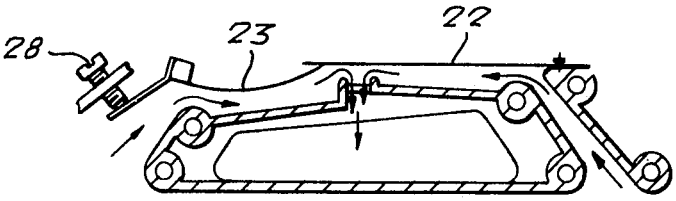
Figure 4:
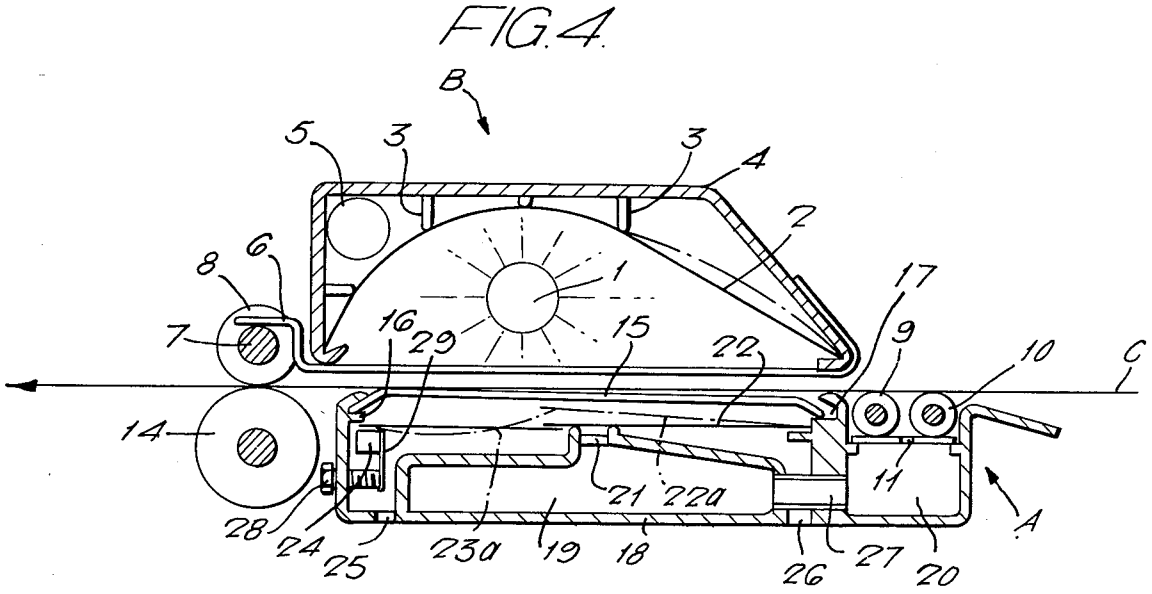

FIGS. 3*a* to 3*d* show, as a schematic section corresponding to FIG. 1, the machine at four different times during a fusing cycle; and FIG. 4 shows a sectional view of an alternative embodiment of the fuser according to the invention.

Figure 2:
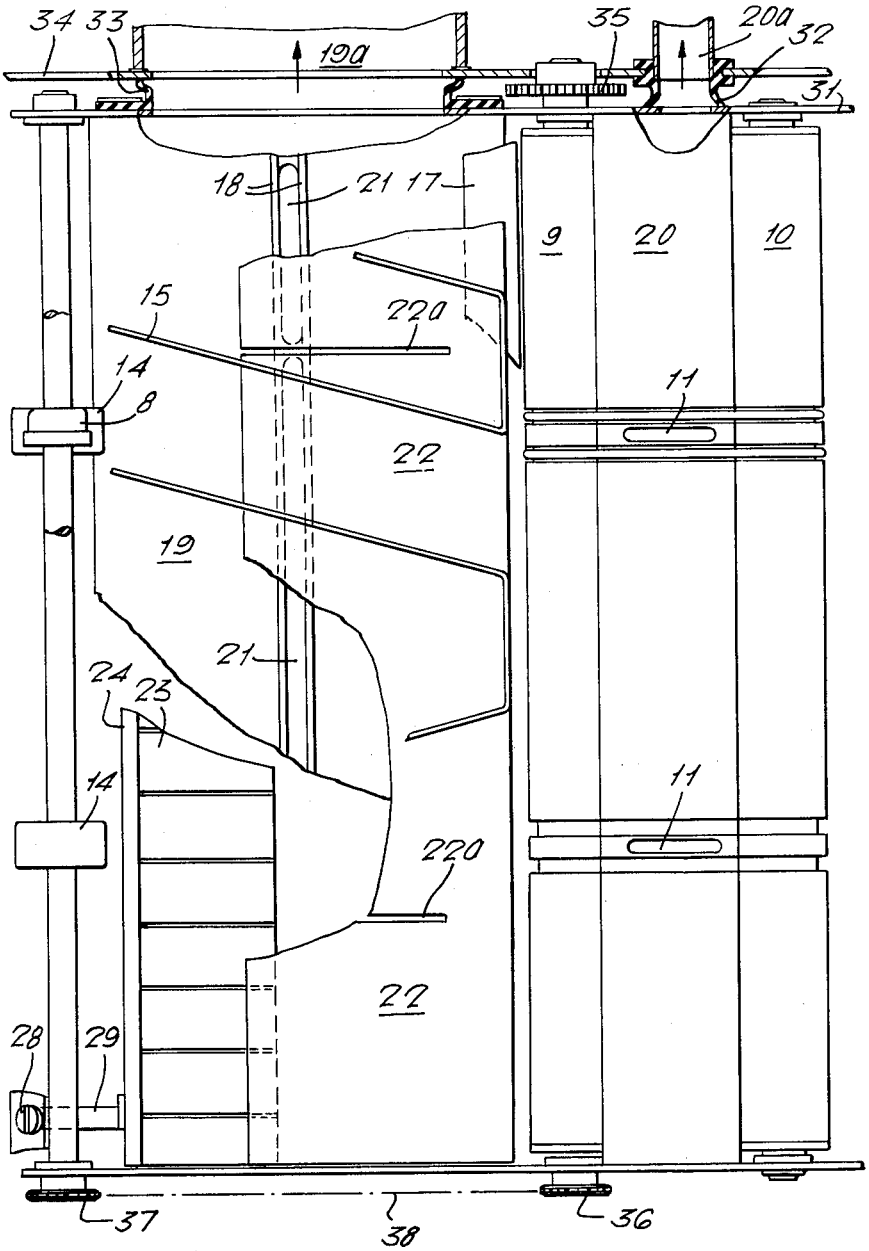
FIG. 2 is a top plan view showing the fuser of FIG. 1.

The fuser shown in FIGS. 1 and 2 comprises a bed A and a cover B between which a sheet C of copy paper is fed for fusing of a delicate powder image on the sheet C. The heat source for the fuser comprises a radiant heater lamp 1 positioned under and at the focus of a reflector 2 designed to distribute the infra-red radiation from lamp 1 across the full length of the fuser bed A i.e. from the fuser inlet as the right hand end of the section shown in FIG. 1 to the fuser outlet at the left hand end. The reflector 2, which is sprung into the fuser cover body 4 and is supported on lugs 3 formed inwardly of a fuser cover body 4, extends across the full width of the fuser, i.e. into and out of the plane of paper in FIG. 1 so that the radiation from the lamp is distributed evenly over the copy paper C carrying the toner to be fused. The fuser cover B includes the cover body 4 secured to the machine frame of the copier.

The cover body 4 is closed by means of a heat pervious grill 6 consisting of wires extending in the direction of sheet movement and right along the opening of the fuser cover 4 to prevent the sheet bowing upwardly, during feed through the fuser, to rise too close to the lamp and present a fire hazard.

The passage of sheets C of paper through the fuser is controlled by a primary feed conveyor consisting of two parallel, horizontally spaced rollers 9 and 10, respectively located just above a suction inlet port 11 which extends along the gap between rollers 9 and 10. The rollers 9 and 10 support an endless feed belt 30 which is provided with apertures to allow suction in the inlet port 11 to be applied through the belt 30 onto the sheets to hold them down onto the horizontal top run of the belt. The port 11 is communicated with a suction passage 20.

At the downstream end of the fuser, an upper secondary feed roller 8 bears downwardly on the sheet, on its side bearing the now fused image, to hold the sheet C down into contact with a lower secondary feed roller 14.

Drive to the primary and secondary sheet feed assemblies is connected by way of a gear wheel 35 (FIG. 2) which is driven from above by a similar gear wheel 35*a* (FIG. 1) rotating on a fixed axis in the copier so that as the fuser bed A is raised into position below the photoconductor drum by pivoting about the hinge pin 18*a*, the gear wheels 35 and 35*a* mesh together.

Drive from the roller 9 of the primary feed unit to the roller 10 of the primary feed unit is automatically transferred by way of the conveyor belt 30, and similarly drive from the roller 9 of the primary feed unit to the lower secondary feed roller 14 is conveyed by way of sprockets 36 and 37 interconnected by a drive chain 38 shown in FIG. 2.

During its passage through the fuser, the sheet C is guided between the upper grill 6 and the fuser bed A by means of a further wire grill 15 similar to grill 6 of the fuser cover B and mounted on downstream and upstream ledges 16 and 17, respectively, of the fuser bed body 18.

At its right hand end as viewed in FIG. 1, the fuser bed body 18 is hinged to the machine frame of the copier, at 18*a*, thereby being capable of dropping clear of the fuser cover B, when required, for example to clear a sheet arrested in the fuser, or for maintenance reasons.

The lower part of the fuser bed body 18 includes a plenum chamber 19 for a suction cooling system which is linked to a suction pipe 19*a* of the copier machine. A similar suction pipe 20*a* also applies suction to the inlet port 11 between the rollers 9 and 10 of the primary feed conveyor, by way of passage 20.

The plenum chamber 19 extends across the full width of the fuser bed A and has all the way along its top suction inlet slit 21 which is normally closed by a set of closure plate strips 22 resting on respective bimetallic strips 23 fixed to a common rotatable square section support bar 24 at the left hand, i.e. downstream, end of the fuser bed body 18. Each closure plate strip is of resilient material and is clamped at the right hand end, as viewed in FIG. 1, by clamp bolts (not shown).

Inlet slits 25 and 26 across the fuser bed body 18 serve as entry ports for cooling air which is sucked in when required.

Both the bimetallic strips 23 and the closure plate strips 22 are blackened at least over their upper surfaces to absorb the infra-red radiation from lamp 1 and to radiate heat back up onto the underside of a sheet C passing the fuser.

As shown in FIG. 2, the plenum chamber 19 and the suction passage 20 are separately connected to an external suction source, or to two respective suction sources if desired, by way of a suction pipe 19*a* for the plenum chamber 19 and a further, smaller diameter suction pipe 20*a* for the suction passage 20. The arrangement of FIG. 2 is such that when the fuser bed A is to be dropped from its FIG. 1 position, for example for the purpose of allowing access to remove a sheet or for maintenance purposes, the side plate 31 of the fuser bed A is withdrawn away from the adjacent end plate 34 of the suction pipes 19*a* and 20*a* (i.e. downwardly as viewed in FIG. 2) by a small distance to allow free pivoting of the fuser bed A out of line with the suction pipes 19*a* and 20*a* without damaging the lips of either a seal 31 carried by the end plate 34 around the suction pipe 20*a* or a seal 33 carried by the side plate 31 around the end of the plenum chamber 19. The seals 32 and 33 have cross-sections corresponding to those of the suction pipes 20*a* and 19*a* so that when the fuser bed A is raised to the FIG. 1 position and slid sideways into the FIG. 2 position where it can be clamped by means not shown, the two seals 32 and 33 will automatically restore suction-supporting sealing effect between, on the one hand the plenum chamber 19 and its suction pipe 19*a*, and, on the other hand, the suction passage 20 and suction pipe 20*a*.

FIGS. 3*a*, 3*b*, 3*c* and 3*d* show the fuser bed during various stages of operation, these views being in the form of sectional views corresponding to FIG. 1.

When starting from the "cold fuser" condition of FIG. 3*a*, radiant heat from the lamp 1 heats up each bimetallic strip 23, that bimetallic strip bends towards its FIG. 3*d* position. In doing so, it first of all lifts the tab 29 into contact with the screw 28 as shown in FIG. 3*b*. Next the end of the strip 23 lifts into contact with the closure plate strip 22 as shown in FIG. 3*c*. Subsequently the strip 23 lifts the closure plate strip 22 clear of the suction inlet slit 21 to the plenum chamber 19 to initiate cooling air flow through the fuser, as shown in FIG. 3*d*. During sheet feed the fuser bed tends to return to the FIG. 3*c* position as heat radiation to the strips 22, 23 is interrupted by the passing sheets.

The operation of the fusing system illustrated in the drawing is as follows:

Initially the fuser lamp 1 is energised at the start of a copy cycle of the electrostatic copier in which it is incorporated. The power of the lamp 1 may be such that within 30 seconds the fuser bed has reached its operating temperature at which point the various bimetallic strips 23 will begin to bend to lift all of the closure plate strips 22 clear of the slit 21, thereby causing flow of cooling air to commence uniformly at all stations across the fuser bed body 18.

Once the temperature in the fuser bed A reaches a value which corresponds to the maximum intended working temperature of the fuser, the radiant heat emitted from the lamp 1 will have heated all of the bimetallic strips 23 and closure plate strips 22 to such an extent that each bimetallic strip 23 will have bent to its FIG. 3*d* position and thereby have raised the associated one of the closure plates 22 to its corresponding position. This will expose the suction inlet opening 21 uniformly across the fuser bed A to allow an air flow to be induced through the inlet slits 25 and 26 to cause a cooling flow through the fuser bed A, thereby holding the temperature of the solid parts of the fuser bed down at a desired equilibrium temperature suitable for ensuring that shortly when a copy sheet C passes over the bed the background temperature of the paper material is raised by virtue of radiation, but mostly conduction and convection, of heat from the hot parts of the fuser bed i.e. from the bimetallic strips 23 and the closure plate strips 22.

Thereafter, the temperature will arrive at a stabilised value at which, as shown in FIG. 3*d*, the curvature of each bimetallic strip 23 is such that the flow of cooling air through that part of the suction slit 21 in register therewith balances the heat absorbed by the strip 23 and the closure plate strip 22 supported by it. If, for any reason, the temperature of the bimetallic strip drops, the strip 23 begins to straighten to throttle further the suction cooling flow entering through that part of the opening 21 thereby preventing further rapid cooling, and giving the strip 23 and the closure plate strip 22 supported on it a chance to absorb more radiant heat from the lamp 1 provided no sheet C is passing at that precise instant. If for any reason the temperature rises above the desired stable value at any strip 23 then the curvature of that strip 23 increases to remove some of the constrictive effect on the flow of air through that part of the slit 21 thereby increasing the cooling effect.

It will be understood that with the present invention the local temperature across the fuser is automatically controlled to prevent overheating since there will be an automatic temperature-responsive increase in the suction cooling air flow.

As shown in the plan view of FIG. 2, there are several bimetallic strips 23 carried independently on a single support shaft 24. The rotation of the support shaft 24 enables adjustment of the datum setting for the temperature at which the strip 23 will start to lift the closure plate assembly 22.

The provision of several independent bimetallic strips 23 has two main advantages, namely: (a) if a small number of the strips 23 becomes detached from the shaft 24 the temperature-compensating action of the fuser A will be unimpaired, (b) the temperature response of each of several narrow strips 23 is more uniform, for reasons which will be explained below, and (c) the temperature may vary locally, across the fuser (for example when a sheet passing through the fuser is narrower than the full fuser bed width and therefore obscures the radiant heat emitting lamp 1 from the heat - absorbing and - radiating elements 22 and 23 at the central zone of the fuser bed while leaving the elements 22 and 23 near the edges of the fuser bed A exposed to the radiation) but the use of various independent strips 23 enables a uniform temperature distribution to be restored (as will be described in more detail below).

It was indicated in (b) above that the temperature response is more uniform when a narrow elongate strip 23 is used as the bimetallic element. The reason for this is that if the bimetallic element were to be substantially square in shape, the differential expansion would occur simultaneously in two mutually perpendicular directions in the plane of the bimetal plate and consequently each of two perpendicular axes would tend to curl causing the bimetal plate to adopt a "spherical" rather than a "cylindrical" configuration. Although, admittedly, in the case of a strip 23 anchored along one edge to square section bar 24, this "spherical" deformation tendency is reduced, but the "spherical" deformation mode would have the effects of both tearing at the bond between the bimetallic plate 23 and the rod 24 thereby weakening the joint, and causing a discontinuity in the temperature response.

Where a bimetal plate clamped along one edge deforms in the "spherical" mode the deformation is resisted by the clamping until suddenly the bimetal flicks into a raised configuration, giving a non-uniform response to temperature. In the illustration of FIG. 2, each strip has an aspect ratio of approximately 2:1 and is bonded at one of its shorter sides to the rod 24, and will therefore deform into the "cylindrical" mode rather than the "spherical" mode, with more uniform temperature response in that the right-hand edge as viewed in FIG. 1 will lift with little or no curling of the minor axis of each strip 23, and no sudden "flicking" will occur.

With regard to the partitioning of the closure plate member 22 to form separate strips, FIG. 2 shows one of two slits **22*a* present in one particular form of partitioning of this type. Slits 22*a* in the closure plate member separate it into three discrete closure plate strips 22, and it is thus possible to provide for lifting of one section of the closure plate 22 independently of the positioning of the adjacent strip or portion of the plate 22**.

Without any such slits **22*a*, differential lifting of the various bimetallic strips 23 across the width of the fuser bed A (for example upon passage of a narrow sheet through the fuser) would cause bowing of the plate 22. A similar "bowing" effect would be imparted where there is, for any reason, a non-uniform radiant heat distribution along the length of the lamp 1**.

At the ends of the lamp 1, i.e. adjacent the lateral extremities of the fuser bed A, there will be a tendency for the heat radiation intensity to drop off and for the temperature of the heat-absorbing elements 22 and 23 at the edges of the fuser to be lower than that of the elements 22, 23 near the centre of the fuser. To some extent this can be compensated for by selecting an appropriately modified heat distribution characteristic of the strip lamp 1 (the characteristic being plotted in terms of heat intensity along the length of the lamp) but even so it is an advantage to separate the portions of the closure plate 22 near the ends of the lamp from the portions near the centre of the fuser bed A. This is achieved by the two separate slits **22*a* shown in FIG. 2**.

Other configurations of slitting may be provided and it is not even necessary for all the slits to be of the same length. For example, there may be two slits having a length similar to that of slit **22*a* illustrated in FIG. 2 and separate slits in between them each having a length shorter than that of the slit 22*a* shown in FIG. 2**.

Underneath the slit **22*a*, as shown in FIG. 2, there is a localised blanking of the cooling air port 21 so that when the temperature of the various heat-absorbing and -radiating element 22 and 23 is below the threshold temperature for onset of cooling flow, there will be no tendency for air to leak down through the slit 22*a* and into the port 21**.

The temperature control action across the fuser bed A will now be described with reference to FIG. 2. When the copy sheet C being fed is one which extends across the full width of the fuser bed, as shown, then the temperature at all stations across the fuser bed A will begin to drop simultaneously as the leading edge of the sheet C passes over firstly the portions or strips 22 of the closure plate and secondly the bimetallic strips 23 on its passage along the fuser bed A, concealing all the various strips 22 and 23 from the radiation source, i.e. lamp 1. Where the bimetallic strips 23 are arranged so that during normal running conditions they are bent upwardly sufficiently to maintain a steady cooling flow (rather than being arranged to lift the closure plate strips 22 only when localised overheating occurs in the fuser bed) the cooling flow will, as the closure plate strips 22 become concealed from the lamp 1, cause a reduction in temperature under the sheet C and once this trend towards reduction in temperature of the fuser bed reaches the bimetallic strips 23, as they become concealed by the leading edge of the sheet, the strips 23 will tend to straighten thereby throttling the cooling flow and preventing further drop in temperature.

For correct fusing of the image on the sheet, the supply of heat to the back of the paper must conform to quite closely prescribed tolerances as regards sheet temperature. It is thus important that once the copy sheet C conceals the blackened heat-absorbing and -radiating elements 22, 23 of the fuser bed from the lamp 1, the inherent control system in the fuser bed A should ensure that all across the fuser the temperature is substantially constant so that once the rate of transmission of heat from the lamp 1 to the closure plate strips 22 and bimetallic strips 23 falls off, due to concealment of the strips 22 and 23 from the lamp 1, the rate of cooling also falls off to ensure that the temperature of strips 22 and 23 is still within tolerance after the whose sheet has passed over that particular part of the fuser bed A.

During feeding of a sheet C narrower than the width of the bed A, the correct temperature of the fuser elements 22, 23 will be maintained even at those parts of the fuser bed A which lie beyond the marginal regions of the sheet C where the rate of heat transmission from the lamp 1 to those strips 22, 23 will remain high due to continued exposure to the lamp, thereby guarding against any tendency for localised overheating along the edge of the paper sheet. Thus, at all those locations across the fuser bed A which are covered by the sheet, concealment of the lamp 1 will eventually result in throttling or complete cessation of the flow of cooling air. On the other hand, at all locations beyond the lateral margins of the sheet C, the rate of heat transmission and the rate of cooling air flow will be unaltered and equilibrium temperature will be maintained.

Because the suction flow into the slit 21 passes directly underneath the closure plate strips 22, a reduced static air pressure will result on the underside of end plate 22 as compared with the static air pressure prevailing above the plate 22 and the resulting pressure differential tends to assist the resilience of the spring steel closure plate strip 22 in causing a downthrust on the free end of the closure plate strip 22, thereby maintaining the associated arcuate bimetallic strip 23 under flexural stress tending to straighten the strip 23. Thus, the strip 23 will always be under a straightening force which varies in accordance with the suction and the stress due to differential expansion of the layers making up the bimetallic strip 23. This avoids thermal lag in each temperature control system comprising one strip 22 and its associated strips 23 and the response of the strip 23 to changes in temperature will be virtually instantaneous.

The steady state may be one in which a continuous air flow is varied in accordance with the temperature sensed, or the air may normally be shut off but flow started up in the event of overheating.

The system illustrated in FIGS. 1 and 2 is purely mechanical so there is no need for sophisticated electronic control techniques, and it also has the advantage of providing a cheap and reliable means of controlling the temperature locally at all stations across the fuser bed A. The reliability of the device is therefore extremely attractive for commercial operation, and where temperature control depends upon the controlled throttling of a continuously operating suction cooling flow, a relatively high power lamp 1 can be used and this will ensure that fast warm-up is possible.

In order to achieve fusing of a toner image onto a sheet, the sheet C is initially advanced by the primary feed rolls 9 and 10 forwardly into the fuser gap with the fuser lamp 1 already energised so that the intensity of radiant heat impinging on the strips 22 and 23 of the fuser bed A has brought the fuser bed up to temperature.

During passage through the fuser, the sheet C has its top surface exposed to the radiation from lamp 1 to fuse the image to the paper. The black toner on the paper C absorbs the radiant heat more readily than the paper so the top surface of the toner will fuse before the heat imparted to the paper, from above, is sufficient to ensure bonding of the fusing image to the paper. It is for this reason that a supplementary heat source below the paper is required for heating the paper rapidly by conduction and convection.

Once the leading edge of the sheet, bearing the fused image, comes into register with the upper and lower secondary feed rollers 8 and 14 the sheet advancing action is taken over by the secondary rollers 8 and 14 which further advance the sheet into the paper receiving tray at the delivery zone of the copier.

The fuser lamp 1 is de-energised at the end of the copying cycle or the copying run in the case of a multiple-copy run.

Adjustment of the temperature range in which the bimetallic thermostat is effective can be achieved by means of an adjusting screw 28 threadedly engageable with the fuser housing and arranged to abut a rigid tab 29 extending downwardly from and fixed to the rotatable square section bar 24 which carries all of the bimetallic strips 23.

As the screw 28 is rotated to urge the bottom of the tab 29 rightwardly, as viewed in FIG. 1, the bar 24 will rotate in the anti-clockwise sense to lift the right-hand end of each bimetallic strip 23 and hence to bias the free end of the closure plate strip 22 upwardly, i.e. in a direction opening the cooling air slit 21. Thus rotation of the screw 28 in this direction lowers the upper limit of the temperature range over which the cooling flow is operative.

When the screw is rotated in the opposite direction the resilience of the closure plate strips 22, and the pressure differential on the strips 22 and 23, act to rotate the bar 24 in the clockwise sense so that the tab 29 follows the retracting screw 28 and the range of temperatures is raised.

Conventional electrostatic copier fuser units already include a supplementary heater behind the paper in order to ensure that heat is supplied to the paper separately from the infra-red radiation on the image-defining toner particles but the advantage of the present invention is that the conventional separately energised electric supplementary heater can be replaced by an assembly of bimetallic strips and spring steel closure plate strips which together serve as both supplementary heat source and thermostatic control means therefor. Moreover, this control means is effective to maintain constant temperature across the whole of the fuser bed A avoiding the possibility of any localised hot spots.

An alternative embodiment of the fuser is shown in FIG. 4 which is a side sectional view corresponding to FIG. 1.

In this case all those elements of the fuser which are analogous to elements shown in FIGS. 1 and 2 are given the same reference numerals.

The differences between the embodiment of FIG. 1 and that of FIG. 4 include the following. In FIG. 4 the fuser is intended to be positioned away from a photoconductor drum and thus opening of the fuser for maintenance or for removal of a sheet will be by way of a hinge (not shown) along the right-hand edge of the fuser cover B (as viewed in FIG. 4) to gain access to the fuser bed A, after which the cover B can be returned to the FIG. 4 position where extensions at the left hand end of the grill 6 of the fuser cover B rest on the drive shaft of the upper secondary feed roller 8.

The suction port for the cooling air flow through the fuser cover B, i.e. between the fuser cover body 4 and the reflector 2, is shown at 5 in FIG. 4.

Furthermore, in FIG. 4 the primary feed unit consists of two spaced feed rollers 9 and 10 which are not provided with the foraminous conveyor belt 30 of FIG. 1.

In FIG. 4 the plenum chamber 19 is connected to suction passage 20 for enabling a common suction-source to suffice for both cooling the strips 22, 23 and assisting the primary feed rollers 9 and 10.

So that the fuser cover B of FIG. 4 is suitable for high temperature operation the reflector 2 is merely sprung against the rib 3 of the fuser cover body 4, enabling the end of the reflector 2 at the rear edge, i.e. the righthand end viewed in the drawing, to deflect upon expansion without seriously distorting the parabolic contour of the reflector portion directly above the lamp 1. Also a suction outlet (not shown) in the fuser cover body 4 is arranged to draw cooling air across the cover body 4 between the upper wall of the cover body 4 and the reflector 2.

In FIGS. 1 and 2, which show a later development of the fuser the cross-sectional shapes of the fuser bed body 18 and plenum chamber 19 have been chosen to present a smoother path to the incoming cooling air flow from entry ports 25 and 26. In order further to enhance the cooling effect without having to increase the suction head in the copier, the plenum chamber 19 is in FIGS. 1 and 2 evacuated through a large cross-section suction pipe 19*a* rather than by way of the smaller suction passage 20 and the interconnecting pipe 27 as in FIG. 4.

We claim:

1. A fuser for an electrostatic copier, comprising a fuser bed; means for advancing over said bed a sheet bearing an unfused image; a radiant heat source above said fuser bed; a reflector disposed above said heat source and arranged to direct radiation from said heat source towards said fuser bed for fusing a delicate toner image on a sheet of copy paper being passed over said fuser bed by said advancing means in use of the fuser; heat-absorbing and -radiating means disposed in said fuser bed; means for admitting air to said fuser bed below the said heat-radiating and -absorbing means; a cooling air port just below said heat-absorbing and -radiating means; an outlet passage from said fuser bed in communication with said cooling air port; means for connecting a suction source to said outlet from the fuser bed to induce airflow through said fuser bed directly below and in contact with said heat-absorbing and -radiating means by way of said means for admitting air, said cooling air port and said outlet; and thermostatic control means for throttling said cooling airflow through said port in response to the temperature of said heat-absorbing and -radiating means.

2. A fuser according to claim 1, wherein said means for advancing a sheet include a sheet-advancing conveyor arranged at an inlet end of said fuser bed and a suction port below said conveyor, means connecting said suction port to a suction source for holding down a copy sheet on said conveyor belt.

3. A fuser according to claim 1, and including a fuser cover carrying said reflector and lamp, said fuser cover including: a cover body disposed above and spaced from said reflector, and means for passing a cooling air flow through the spacing between said body and said reflector for cooling said fuser cover body.

4. A fuser according to claim 3, wherein said reflector is of parabolic form and is sprung into said fuser cover body so as to be capable of expansion without distortion of the portion of said reflector immediately above the lamp.

5. A fuser according to claim 4, and including ribs depending downwardly from said fuser cover body for engaging the top face of said reflector.

6. A fuser according to claim 3, wherein said fuser cover includes a grill disposed across the lower face of said fuser cover for preventing a sheet of copy paper from entering the space enclosed by said reflector.

7. A fuser for an electrostatic copier, comprising a fuser bed; means for advancing over said bed a sheet bearing an unfused image; a radiant heat source above said fuser bed; reflector means disposed above said heat source and arranged to direct radiation from said heat source towards said fuser bed for fusing a delicate toner image on a sheet of copy paper being passed over said fuser bed by said advancing means in use of the fuser; first elongate means of bimetallic construction; means clamping said first elongate means at one end, the other end of said first elongate means being free to bend upon differential expansion in response to the temperature of said first elongate means; plate means having an edge overlying and resting on said other end of said first elongate means for lifting and lowering in response to deformation of said bimetallic first elongate means, whereby in use of the fuser heat from said radiant heat source is absorbed by said first elongate mean and said plate means in the absence of a sheet passing therebetween and is radiated back onto a sheet when a sheet is disposed between the radiant heat source and said first elongate means and plate means; means for admitting air to said fuser bed below said first elongate means and said plate means; a cooling air port just below said plate means; an outlet passage from said fuser bed in communication with said cooling air port; and means for connecting a suction source to said outlet from the fuser bed to induce air flow through said fuser bed directly below and in contact with said first elongate means and said plate means by way of said means for admitting air, said cooling air port and said outlet; whereby thermal-responsive bending of said bimetallic first elongate means will lift and lower said plate means to open and close said cooling air port for variably throttling the cooling air flow in response to the thermal-responsive bending of said first elongate means.

8. A fuser according to claim 7, wherein said first elongate means comprise several first elongate elements in an array across the fuser bed with each first elongate element of the array extending along the fuser bed; and said plate means comprise several plate elements arranged such that each said plate element has an edge overlying the free end edge of a respective one of said first elongate elements, whereby the thermal-responsive bending of each said first elongate element is independent of the bending of the next adjacent first elongate element and the raising and lowering of each said plate element is independent of that of the next adjacent plate element.

9. A fuser according to claim 8 and further including means for varying the position of the said first elongate element for adjusting the range of temperatures of said first elongate elements over which said cooling air port is opened.

10. A fuser according to claim 7 wherein said heat-absorbing and -radiating first elongate elements and plate elements have a blackened upper surface to increase their heat-absorbing and -radiating capability.

* * * * *